United States Patent [19]

Brünig

[11] Patent Number: 4,750,673

[45] Date of Patent: Jun. 14, 1988

[54] FAN APPARATUS FOR HEATING AND CIRCULATING AIR

[76] Inventor: Matthias A. M. Brünig, Diekbarg 48, D-2000 Hamburg 65, Fed. Rep. of Germany

[21] Appl. No.: 907,925

[22] Filed: Sep. 16, 1986

[30] Foreign Application Priority Data

Sep. 17, 1985 [DE] Fed. Rep. of Germany ... 8526486[U]

[51] Int. Cl.[4] ..... F24H 3/04

[52] U.S. Cl. ..... 237/50; 98/30; 98/31.6; 219/360; 219/362; 219/370; 237/78 R

[58] Field of Search ..... 98/30, 31.5, 31.6; 219/360, 362, 370; 237/50, 78 R

[56] References Cited

U.S. PATENT DOCUMENTS

| | | | |
|---|---|---|---|
| 2,221,045 | 11/1940 | Edington | 219/370 X |
| 2,359,021 | 9/1944 | Campbell et al. | 98/31.6 X |
| 3,827,342 | 8/1974 | Hughes | 98/31.5 |
| 4,053,732 | 10/1977 | Carter | 98/31.6 X |
| 4,064,203 | 12/1977 | Cox | 98/31.5 X |
| 4,181,690 | 1/1980 | Heu | 98/30 X |
| 4,616,557 | 10/1986 | Paoluccio | 98/31.5 |

FOREIGN PATENT DOCUMENTS

| | | | |
|---|---|---|---|
| 715690 | 8/1965 | Canada | 219/370 |
| 599050 | 12/1925 | France | 98/31.5 |
| 54-154148 | 12/1979 | Japan | 98/31.5 |
| 580187 | 8/1946 | United Kingdom | 98/31.6 |
| 832261 | 5/1981 | U.S.S.R. | 98/31.6 |

*Primary Examiner*—Harold Joyce

*Attorney, Agent, or Firm*—Sughrue, Mion, Zinn, Macpeak and Seas

[57] ABSTRACT

A fan apparatus for heating and circulating a large volume of relatively low temperature air in a room space includes a circular base plate (1), a centrally mounted motor driven fan (3), (4), and an annular heating coil (2) upstanding from the base plate in the flow path of radially outwardly air currents generated by the fan and deflected by the plate.

2 Claims, 1 Drawing Sheet

FAN APPARATUS FOR HEATING AND CIRCULATING AIR

BACKGROUND OF THE INVENTION

This invention concerns an apparatus for heating, circulating, humidifying, filtering and cleaning the air in rooms. The apparatus has a motor-driven fan and, where desired, heating elements, a filter, and water containers in the airstream of the fan.

Previous air-heating blowers drive a relatively narrow stream of air over heating coils at great speed, whereby hot air is blown into a room in a controlled stream.

SUMMARY OF THE INVENTION

This invention provides an air-heating blower which moves a large mass of air at a low speed over heating coils, and thereby heats a room with airstreams of comparatively mild or low temperature air. Large amounts of heat can thereby be injected into the air.

DETAILED DESCRIPTION OF THE PREFERRED EMBODIMENTS

Figure 1:
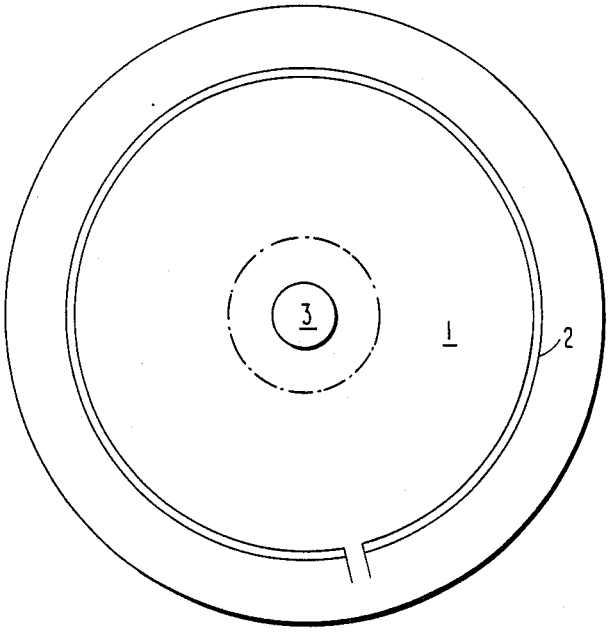
FIG. 1 shows a top view of a fan apparatus in accordance with the invention.
Figure 2:
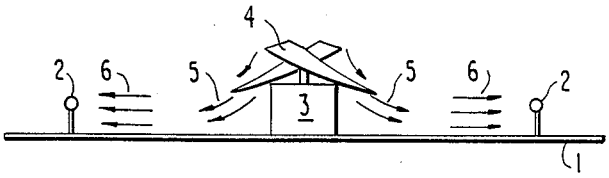
FIG. 2 and FIG. 3 show sections of specific designs in accordance with the invention.

The apparatus comprises a base plate 1 close to the edge of which and conforming to its shape a heating wire 2 is held by insulated rods. In the center of the base plate is an electric motor 3 with a vertical shaft on which a fan 4 generates airstreams 5 deflected radially outwardly by the base plate 1. Heating wire 2, which can also be led around the edge of the base plate several times, lies within the flow path of wall currents 6 which permits heat to flow radially.

Aside from its simple construction, the device has the advantage of resting on the floor and radiating uniform heat throughout the room. It can also be attached to the wall, thereby providing, in such a vertical position, uniform heat to the wall of a room.

When the heating coils are turned off, the apparatus can be attached on the wall, ceiling, or floor as a room ventilation or air circulation device.

With a suitable filter 9 attached circularly below the fan, where the air bounces vertically against the base plate, the apparatus is an excellent dust remover or general air filter.

Figure 3:
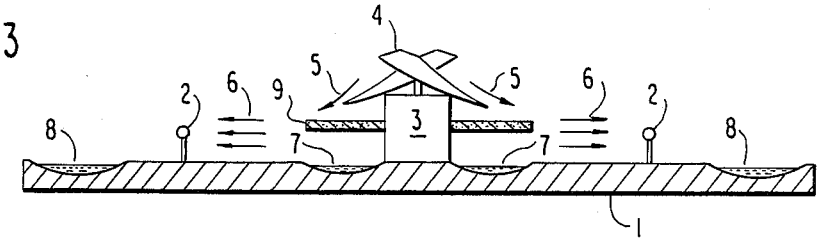

When the apparatus is to be operated only in a horizontal position, a circular depression in the base plate below the fan can be provided for holding water 7, as seen in FIG. 3, which causes air impurities to be separated out. A water ring 8 outside the heating coils can serve as a humidifier.

To achieve silent and energy efficient operations it is particularly appropriate to use an encased fan for generating the baffled and deflected air, by providing a cone-shaped or semi-circular cover above the apparatus (not shown). A wire or plastic grate with a spatial arrangement that permits the passage of an even flow of air is an appropriate cover.

Instead of electric heat, gas or oil heat can also be used.

I claim:

1. A fan apparatus for heating and circulating a large volume of relatively low temperature air in a room space, comprising:

(a) a circular, generally planar base plate (1), (b) a motor (3) centrally mounted to the base plate and having a shaft extending outwardly perpendicular to the base plate, (c) a fan (4) secured to and driven by the motor shaft, and having blades oriented to direct a large volume of air toward the base plate at a relatively slow speed, said air being thereafter deflected radially outwardly by the base plate, and (d) an annular heating coil (2) mounted to and upstanding from the base plate, said heating coils surrounding the motor and fan, and being disposed radially outwardly therefrom in a flow path of the air deflected by the base plate, wherein:

(e) the diameter of the base plate is at least three times greater than the diameter of the fan, (f) the base plate is horizontally disposed, and defines (g) an inner circular trough (7) surrounding the motor and disposed inwardly of the coil for containing dust particle separation water, and (h) an outer circular trough (8) surrounding the coil outwardly therefrom for containing humidification water.

2. An apparatus according to claim 1, further comprising an air filter (9) surrounding the motor and disposed between the fan and the base plate.

* * * * *